United States Patent [19]

Ivey, Jr.

[11] 3,963,692

[45] June 15, 1976

[54] SULFUR-CHLORINATED POLYNUCLEAR AROMATIC AND FAT MIXTURE

[75] Inventor: Herbert D. Ivey, Jr., Pasadena, Calif.

[73] Assignee: Lubricaton Company of America, Los Angeles, Calif.

[22] Filed: June 27, 1974

[21] Appl. No.: 483,657

[52] U.S. Cl. ..... 260/125; 260/139; 252/48.4

[51] Int. Cl.[2] ..... C07G 17/00

[58] Field of Search ..... 260/125, 139; 252/48.4

[56] References Cited

UNITED STATES PATENTS

| | | | |
|---|---|---|---|
| 2,313,611 | 3/1943 | Abramowitz et al. | 260/125 |
| 2,706,176 | 4/1955 | Frazier | 260/125 |
| 3,316,237 | 4/1967 | Imparato et al. | 260/125 |
| 3,455,896 | 7/1969 | Herder et al. | 260/125 |
| 3,825,495 | 7/1974 | Newingham et al. | 260/139 |
| 3,847,827 | 11/1974 | Dinsmore et al. | 260/125 |

*Primary Examiner*—Lewis Gotts
*Assistant Examiner*—D. R. Phillips
*Attorney, Agent, or Firm*—Lyon & Lyon

[57] ABSTRACT

A sulfur-chlorinated cyclic oil-fat product for use as the extreme pressure additive to cutting, drawing, lubricating, gear, and like oils is disclosed. The cyclic substituents contains a substantial amount of polynuclear aromatics which is generally a waste product of a catalytic cracking refinery process while the fat product may be the free acids of animal and vegetable fats, such as acidulated foots, which are the waste products from fats after the glycerine has been extracted, or may be the glycerides themselves. The resulting product is an inexpensive extreme pressure additive which, in small percentages, greatly enhances the pressure bearing capacity of a lubricating oil.

7 Claims, No Drawings

SULFUR-CHLORINATED POLYNUCLEAR AROMATIC AND FAT MIXTURE

BACKGROUND OF THE INVENTION

This invention generally relates to oils or oil additives exhibiting extreme pressure properties, and more particularly to a sulfur-chlorinated product containing in major proportions cyclic oils and fat products.

In U.S. Patent application, Ser. No. 395,741, filed September 10, 1973 (now U.S. Pat. No. 3,847,827) entitled "Cyclic Sulfur-Chlorinated Oil and Process of Making" and assigned to the same assignee as the present invention, and herein incorporated by reference, disclosed was a process of making sulfurchlorinated cyclic oils having anti-weld properties. Briefly, it was discovered that cyclic oils, which are generally by-products of an oil refining process and which contains substantial amounts of polynuclear aromatic compounds boiling between 350° and 800°F, if reacted with an amount of sulfuric acid less than the maximum amount required to react completely with the oil, but a sufficient amount to precipitate unwanted impurities, and thereafter was sulfur-halogenated by directly reacting it with a sulfur halide, after removal of any resulting sludge and hydrogen halide, a stable and homogeneous oil exhibiting anti-weld and some extreme pressure properties could be obtained.

The use of various fatty substances to enhance the extreme pressure properties of an oil is known, including the use of sulfur-chlorinated fats to this end. The ability of certain fats, especially sulfur-chlorinated fats to enhance the extreme pressure properties of a lubricating oil, is thought to be due, in part, to the extremely good wetting properties of such fatty substances. See, for example, U.S. Pat. No. 2,694,046 which discloses sulfur-chlorinated fatty materials such as oleic acids, lard oil, and the methyl esters of lard oil.

However, in recent years, the cost of such fatty oils has risen considerably, paralleling the cost of food, since most of these derivatives are obtained from animal fats. These fats, however, find large volume use as a raw material for glycerine which, after glycerine extraction, yields waste products comprising large amounts of fatty acids. These glycerine extracted products are generally obtained by acidulation with an acid such as hydrochloric acid, and are usually known as acidulated foots. Such foots may be obtained from both vegetable and animal sources, as for example, cotton seed foots, soy foots, coconut foods, etc. To date, such acidulated foots have had little or no commercial value, since after glycerine extraction with the hydrochloric acid, the resulting product is usually extreme dark with an offensive odor. Another extremely economical fat product which heretofore has had little commercial value is so called "yellow grease" from food processing wastes, which contains such a variety of vegetable and mineral fats that further treatment and separation of components is generally not feasible.

Although sulfur-chlorinated cyclic oils by themselves, as generally disclosed in the previous referenced application, have been found to exhibit not only good anti-weld properties, but some extreme pressure properties, greatly enhanced extreme pressure properties with improved wetting may be obtained by mixing these cyclic oils with sulfur-chlorinated fatty derivatives. However, in most instances, the addition of known and available sulfur-chlorinated fats greatly increases the cost of the previously economical sulfur-chlorinated cyclic oil. Sulfur-chlorinating less expensive fat products such as yellow grease or acidulated foots and then attempting to blend them with a cyclic oil is at best a risky business due to limited compatibility and storage life.

SUMMARY OF THE INVENTION

A process of making a stable and compatible sulfur-chlorinated product, being useful as an extreme pressure additive comprising reacting together a fat product including fatty acids or glycerides, a polynuclear aromatic cyclic oil, and a normally liquid sulfur halide, the reaction product yielding a sulfur-chlorinated compound which exhibits equal or better extreme pressure properties and improved compatibility when compared with physical mixtures of sulfur-chlorinated fats and cyclic oils.

More particularly, the fat products may comprise either acidulated foots containing large amounts of free fatty acids, or a yellow grease, such products being the most economically attractive.

PREFERRED EMBODIMENTS

One of the major by-products of a crude oil refining process are cyclic oils generally containing one to four ringed aromatic compounds, such compounds generally having substantially saturated side chains of less than 10 carbon atoms. Such a by-product may also contain naphthenes, other saturated cyclic compounds, as well as olefins and saturated aliphatic compounds. These by-products, which have undergone cracking in the oil refining process, are generally of little commercial use, since they will readily form a sludge upon further reaction.

In the previous referenced U.S. Pat. No. 3,847,827, it was found that by separating out the fraction of such cyclic compounds boiling within a range of 350° and 800°F and preferably between 400° and 700°F, a light cyclic oil, containing as a major ingredient 2 and 3 membered ringed compounds and generally having a viscosity index below 0 could be obtained.

These light cyclic oils, having polynuclear aromatics, were then reacted with up to about 10% w. of sulfuric acid, such amount of acid being sufficient to separate out unwanted impurities which would form a sludge upon subsequent treatment with sulfur monochloride. The insoluble reaction products (green acids) are removed, while the soluble sulfonic acid derivatives (red acids) generally are not extracted or neutralized.

After the sulfuric acid treatment, the cyclic oil is blended with a fat product. Although a wide variety of fat products may be used to enhance the extreme pressure properties, economics is generally the decisive factor. I have found that a wide variety of fat products may be utilized in accordance with this invention, including both acidulated fat foots having extracted therefrom glycerol thereby leaving large amounts of free fatty acids, and a wide variety of animal and vegetable glycerides, such as those commonly found in so called yellow grease. Such greases are waste products of food processing plants, and generally contain large amounts of unsaturated fats.

To this end, it should be kept in mind that if the amount of unsaturation is too high, upon sulfur-chlorination, a large amount of cross-linking may take place. This may result in the fat polymerizing into a rubbery material. Thus, care should be taken, to insure that where a mixture of fatty products is used, such as in the case of yellow grease, that the iodine number of the mixture generally be less than 100.

An important feature of this invention, is the reaction of both the fat product and the sulfuric acid treated cyclic oil simultaneously with the sulfur halide, to cause what is believed to be a certain degree of cross-linking between the fat, which will usually react via an addition reaction since it generally has at least one double bond and the polyaromatic cyclic oil which will generally react via substitution. Although the nature of the reaction is not fully understood, it is believed that both the sulfur and chlorine atoms saturate the olefinic linkage of the fat and add to the side chains of the cycle oil, cross-linking the materials.

Since the rate of reaction of the fat products, are generally much greater than that of polycyclic oils, it is preferable to begin sulfur-chlorination using an excess of cyclic ingredients. I have generally found that a ratio of 2:1 to 4:1 of cyclic oil to fat results in sulfur chlorination of, and reaction between, the fat and oil without excess exotherm or polymerization. After the reaction has proceeded close to completion, additional fat products may then be added. The reaction conditions are substantially the same as those disclosed in U.S. Pat. No. 3,847,827 "Cyclic Sulfur-Chlorinated Oil and Process of Making," previously incorporated by reference. However, the final product of this reaction, exhibits equal or better extreme pressure properties, and better wetting properties than either a sulfurchlorinated fat or oil alone and better compatibility than physical mixtures of fats and cycle oils reacted separately. The invention will become more apparent from the following more specific examples.

EXAMPLE I

Mobil light cycle oil MXY 409, having a distillation range of 400° to 700°F was acid treated with concentrated sulfuric acid at 4% for 90 minutes with agitation and allowed to settle for about four hours. The unneutralized soluble oils were decanted to make part of the charge stock, designated below as treated cycle oil.

EXAMPLE II

The product of Example I was mixed in a 1:1 ratio by weight with mixed acidulated fatty acid foots as bought from Snow Commodities Company. To this mixture was slowly added 15% by weight of $S_2Cl_2$, over a period of several hours. Slow addition is necessary to allow for discharge of gas and to prevent foaming. Heating of the reaction vessel is helpful to complete the reaction in a reasonable time. Iron filings may be used to catalyze the reaction if an iron vessel is not used. The product is then blown with air until free of any HCL byproducts. Also, heat may be used to reduce the product's viscosity to facilitate the escape of gas. A light filtration through cloth brightens the color somewhat. The odor is greatly improved over the odor of the acidulated foots and is quite acceptable for a gear oil and cutting oil additive.

EXAMPLE III

The following ingredients were reacted via the process of Example II.

| | |
|---|---|
| Acidulated Soyabean-Corn soap Stock | 43.75% |

-continued

| | |
|---|---|
| Treated Cyclic Oil | 43.75% |
| $S_2Cl_2$ | 12.5 % |

After 10% $S_2Cl_2$ was added, the mixture was heated to 240°F for 3 hours. The final product, when tested on a Copper Strip was positive but wiped off in ordinary solvent. Little sludge and an acceptable odor was obtained. The product had a chlorine content of 5.30%. The oil exhibited excellent compatibility with USP White Oil, Union Oil 90 SSU, Pale Oil 100, SSU. The viscosity was 687 SSU at 100°F and 39.5 at 210°F.

EXAMPLE IV

The following materials were reacted at three hours at 270°F and then at 301°F for one hour:

| | |
|---|---|
| Acidulated Soya-Corn Soap Stock | 400 G |
| MZY 413(Sour Acid Treated Mobil 409 Cyclic Stock) | 400 G |
| $S_2Cl$ (20%) | 200 G |

The Copper Corrosion Test was positive, but after wiping, showed no corrosion. Chlorine content was 5.95% and oil compatibility, (Union 90 SSU 50/50) was good.

EXAMPLE V

Equal part of cottonseed 7 palm soap stock and treated cyclic oil were reacted with about 10% $S_2Cl_2$, similar to Example II. Compatibility and corrosion were the same as Example IV.

EXAMPLE VI

The following sulfur-chlorinated cycle oilfat product blends were tested for compatibility in pale oil and Union Oil 90 as summarized in Table I.

TABLE I

| Mixtures | Pale Oil | | | Union Oil 90 | | |
|---|---|---|---|---|---|---|
| | 5% | 10% | 25% | 5% | 10% | 25% |
| Yellow Grease & Cycle Oil | S | S | S | S | S | S |
| Acidulated Foots & Heavy Cycle Oil | SS | SS | SS | SS | SS | SS |
| Acidulated Foots & cycle oil | SS | SS | SS | SS | SS | SS |
| Fatty acid of tall oil (Acintol 7002 from Arizona Chemical Co.) & Cycle oil | I | I | S | I | I | I |
| Acidulated foots & Aromatic Bottoms | SS | SS | SS | SS | SS | SS |
| Oleic Acid & Cyclic Oil | S | S | S | S | S | S |
| Lard Oil & Cycle oil | S | S | S | S | S | S |
| Tallow & Cycle Oil | S | S | S | S | S | S |

NOTE:
SS = Sludge separating at the bottom
I = Insoluble
SI = Slightly insoluble, shows very little solubility.

Blends were prepared by adding 50 gms. of the fat product to 100 gm. of the treated cycle oil. Added slowly was 15 ml. of $S_2Cl_2$. After the reaction ceased the remaining 50 gms. of the fat product was added and then the remaining 5 ml. of $S_2Cl_2$. HCl was removed via air blowing.

EXAMPLE VII

The products of Example VI were analyzed for total sulfur (ASTM D-129) and Total Chloride (ASTM D-808), the results of which are summarized in Table II.

Table II

| | Total Sulfur | Total Chlorine |
|---|---|---|
| Yellow grease & Cycle Oil | 7.15% | 4.73% |
| Acidulated Foots & Heavy Cycle Oil | 6.74% | 3.59% |
| Acidulated Foots & Cycle Oil | 7.05% | 4.13% |
| Fatty acid of tall oil (Acintol 7002 from Arizona Chemical Co.) & Cycle oil | 7.43% | 4.16% |
| Acidulated Foots & Aromatic Bottoms | 13.70% | 2.10% |
| Oleic Acid & Cyclic Oil | 4.54% | 3.17% |
| Lard Oil & Cycle Oil | 7.46% | 3.15% |
| Tallow & Cycle Oil | 6.28% | 3.96% |

EXAMPLE VII

The yellow grease, cycle oil blend of Examples VI and VII were added at a 2½% level to a 600 sec. SSU mineral petroleum oil having 1% Paratac (Exxon Corp.), a polymer additive to impart tackiness. The formula functioned well as a way oil with no gaulling or wear of the parts. In addition, the material exhibited excellent wetting of the metal, better than a sulfur-chlorinated cycle oil additive or sulfur-chlorinated fat used along.

In summary, it is believed by reacting both a cycle oil and fat product simultaneously with a sulfur halide, a novel reaction product is obtained, such product being more efficient as extreme pressure additives than physical mixtures of sulfur-chlorinated fats and cycle oils and much more compatible.

I claim:

1. An extreme pressure additive comprising the reaction product of, as a first ingredient, a cyclic oil obtained from the cracking of petroleum containing in major proportions polynuclear aromatics boiling between 350° and 800°F and having separated therefrom by sulfuric acid treatment the majority of impurities which form a permanent sludge when reacted with a normally liquid sulfur halide, and as a second ingredient, a fat product, said first and second ingredients being in a ratio of 1:1 to 4:1 and being reacted with a normally liquid sulfur halide to produce a sulfur-chlorinated product useful as an extreme pressure additive.

2. The extreme pressure additive of claim 1 wherein the cyclic oil boils between 400° and 700°F.

3. The extreme pressure additive of claim 1 wherein the sulfur halide is substantially sulfur monochloride.

4. The extreme pressure additive of claim 1 wherein the fat product is an acidulated fat containing free fatty acids.

5. The extreme pressure additive of claim 1 wherein the fat product is selected from the group consisting of lard oil, tallow oil, oleic acid, cottom seed foots, soya foots, and cococut foots.

6. The extreme pressure additive of claim 1 wherein the fat product is yellow grease.

7. The extreme pressure additive of claim 1 wherein the iodide member of said fat product is less than 100.

* * * * *